US010443228B2

(12) United States Patent
Chaillan

(10) Patent No.: US 10,443,228 B2
(45) Date of Patent: Oct. 15, 2019

(54) METHOD OF MANUFACTURING AND ASSEMBLY OF A SERIES OF PREFABRICATED PREFINISHED VOLUMETRIC CONSTRUCTION (PPCV) MODULES

(71) Applicant: DRAGAGES SINGAPORE PTE LTD, Singapore (SG)

(72) Inventor: Gilles Alain Marius Chaillan, Singapore (SG)

(73) Assignee: DRAGAGES SINGAPORE PTE LTD, Singapore (SG)

( * ) Notice: Subject to any disclaimer, the term of this patent is extended or adjusted under 35 U.S.C. 154(b) by 0 days.

(21) Appl. No.: 16/300,387

(22) PCT Filed: Apr. 20, 2017

(86) PCT No.: PCT/SG2017/050219
§ 371 (c)(1),
(2) Date: Nov. 9, 2018

(87) PCT Pub. No.: WO2017/196256
PCT Pub. Date: Nov. 16, 2017

(65) Prior Publication Data

US 2019/0136508 A1 May 9, 2019

(30) Foreign Application Priority Data

May 10, 2016 (SG) ..... 10201603706Q

(51) Int. Cl.
*E04B 1/348* (2006.01)
*E04H 1/00* (2006.01)

(52) U.S. Cl.
CPC ..... *E04B 1/34823* (2013.01); *E04H 1/005* (2013.01)

(58) Field of Classification Search
CPC ..... E04B 1/34823; E04H 1/005
See application file for complete search history.

(56) References Cited

U.S. PATENT DOCUMENTS 3,643,390 A * 2/1972 Shelley ..... E04B 1/34823 52/79.2
4,194,339 A * 3/1980 Fisher ..... E04B 1/34823 52/223.1

(Continued)

FOREIGN PATENT DOCUMENTS

CN 2539781 Y 3/2003

OTHER PUBLICATIONS

International Search Report and Written Opinion issued by the Intellectual Property Office of Singapore, relating to application No. PCT/SG2017/050219 completed on May 23, 2017 and dated May 30, 2017.

*Primary Examiner* — Joshua K Ihezie
(74) *Attorney, Agent, or Firm* — Womble Bond Dickinson (US) LLP; John J. Penny, Jr.

(57) ABSTRACT

A method of manufacturing a series of prefabricated prefinished volumetric construction (PPCV) modules, including the steps of casting a slab of a new module in the series of modules against an adjoining slab of a previous module in the series of modules; casting opposed walls of the new module on opposed sides of the slab, wherein one of said walls is cast against an adjoining wall of said previous module; casting a roof slab on said opposed walls of the new module, the roof slab being cast against an adjoining roof slab of said previous module; separating the new module from the previous module; repeating steps (a) to (d) for each successive module in the series, wherein the side walls of each module in the series of modules are matched to side walls of neighboring modules in the series of modules.

24 Claims, 23 Drawing Sheets

(56) References Cited

U.S. PATENT DOCUMENTS

| | | | | |
|---|---|---|---|---|
| 4,495,131 | A * | 1/1985 | Del Valle | B28B 7/22 264/256 |
| 4,953,280 | A * | 9/1990 | Kitzmiller | B28B 7/0029 249/11 |
| 5,167,842 | A * | 12/1992 | Vercelletto | B28B 7/02 249/129 |
| 6,493,996 | B1 * | 12/2002 | Alexander | E04B 1/34823 52/234 |
| 9,546,044 | B2 * | 1/2017 | Boulton | B65G 5/005 |
| 2006/0150534 | A1 * | 7/2006 | Window | B65D 90/0006 52/79.5 |
| 2009/0145079 | A1 * | 6/2009 | Garcia | B28B 7/22 52/745.19 |
| 2017/0073957 | A1 * | 3/2017 | Fisher | E04H 1/005 |
| 2018/0030718 | A1 * | 2/2018 | Aguila | E04B 1/34823 |

* cited by examiner

METHOD OF MANUFACTURING AND ASSEMBLY OF A SERIES OF PREFABRICATED PREFINISHED VOLUMETRIC CONSTRUCTION (PPCV) MODULES

The present application claims priority under 35 U.S.C. § 119 to Singaporean Patent Application No. 10201603706Q filed on May 10, 2016 in Singapore, and under 35 U.S.C. § 365 to PCT/SG2017/050219 filed on Apr. 20, 2017, the disclosures of which are incorporated herein by reference.

TECHNICAL FIELD OF THE INVENTION

The present invention relates to a method of manufacturing a series of prefabricated prefinished volumetric construction (PPCV) modules; and to a method of assembling the same.

BACKGROUND OF THE INVENTION

Prefinished-Prefabricated-Volumetric-Construction (PPVC) units are currently being used to quickly and efficiently construct buildings. This construction technique requires neighbouring units to be coupled together. Any such couplings need to ensure adequate structural continuity between adjacent modules. It is generally desirable to provide an effective and cost efficient module connection system.

It is desirable to construct PPVC modules such that the modules can be assembled with very small tolerances. It is also desirable to ensure that joined modules provide vertical and horizontal structural continuity.

It is generally desirable to overcome or ameliorate one or more of the above mentioned difficulties, or at least provide a useful alternative.

SUMMARY OF THE INVENTION

According to the present invention, there is provided a method of manufacturing a series of prefabricated prefinished volumetric construction (PPCV) modules, including the steps of:

(a) casting a slab of a new module in the series of modules against an adjoining slab of a previous module in the series of modules;
(b) casting opposed walls of the new module on opposed sides of the slab, wherein one of said walls is cast against an adjoining wall of said previous module;
(c) casting a roof slab on said opposed walls of the new module, the roof slab being cast against an adjoining roof slab of said previous module;
(d) separating the new module from the previous module;
(e) repeating steps (a) to (d) for each successive module in the series, wherein the side walls of each module in the series of modules are matched to side walls of neighbouring modules in the series of modules.

Preferably, the method also includes the steps of:

(a) casting a slab of a first module in the series of modules;
(b) casting opposed walls of the first module on opposed sides of the slab; and
(c) casting a roof slab on said opposed walls of the first module.

Preferably, one or more vertically extending locking channels are cast into outer articular surfaces of the side walls of each module. The locking channels span an entire wall height of the walls of each module. The locking channels of each module are lipped. The lipped channels are coupled to studs of reinforcement bars installed in the walls of the modules during the casting step.

According to the present invention, there is also provided a method of assembling a plurality of prefabricated prefinished volumetric construction (PPCV) modules, each being formed in accordance with the above described method, including the steps of:

(a) positioning a module in the series of modules against a matched previous module in the series;
(b) coupling the module and the previous module together; and
(c) repeating steps (a) and (b) for each successive module in the series.

Preferably, the step of positioning includes arranging corresponding locking channels to overly one another to form combined locking conduits of vertical locks. The step of coupling includes the steps of pouring grout into the vertical locks. The locks ensure the horizontal mechanical continuity of the slabs of the modules to transfer horizontal forces to the various resisting members.

Preferably, the method includes the step of applying a compression force between the modules. The step of applying the compression force is achieved through installing a pre-stressing cable through the modules.

The above described methods preferably provide an effective and cost efficient module connection system.

The above described methods allow assembly of PPVC modules with very small tolerances. The joined modules preferably provide vertical and horizontal structural continuity.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
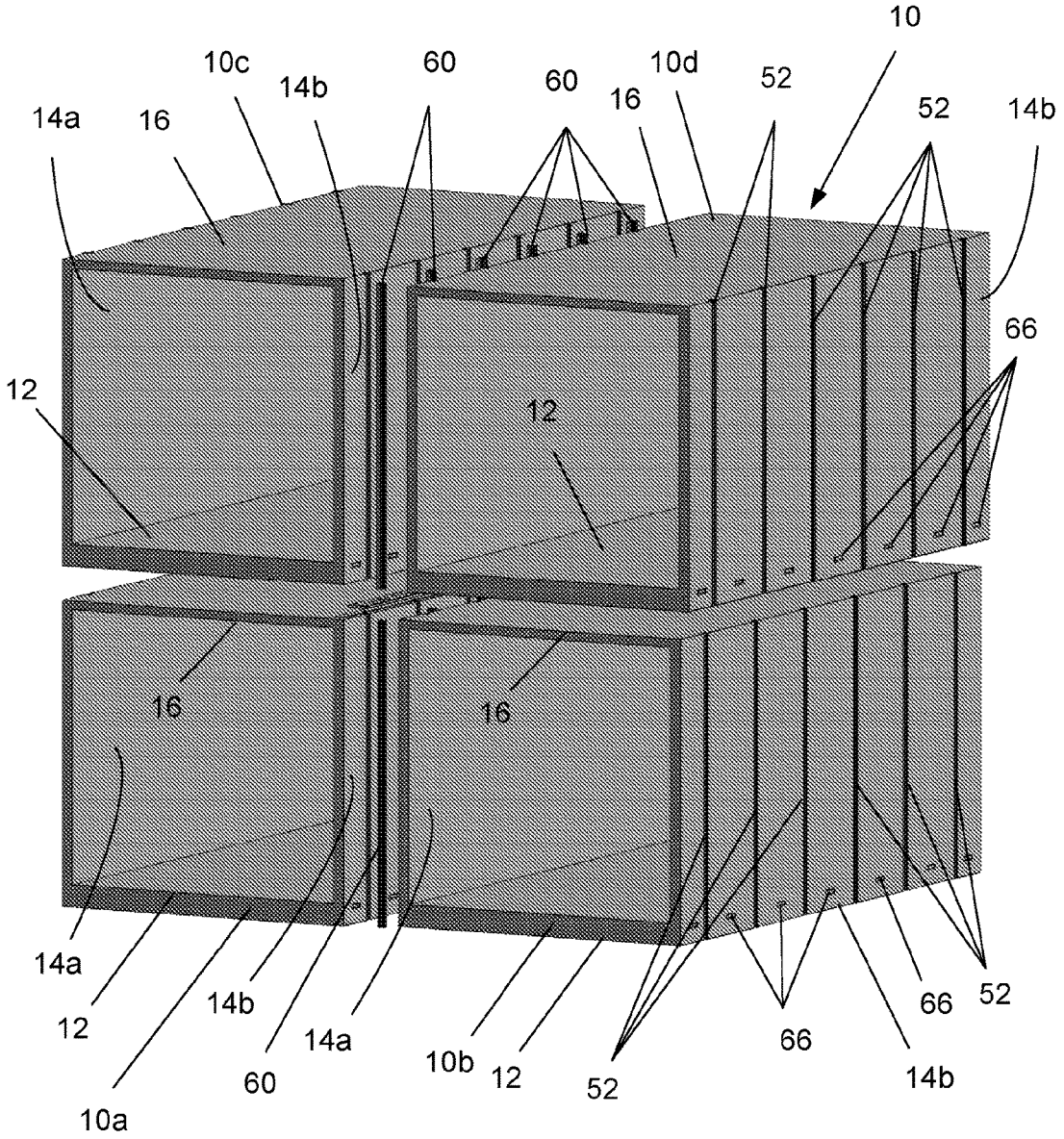
FIG. 1 is an exploded view of modules formed and assembled in accordance with preferred embodiments of the invention.

The series of prefabricated prefinished volumetric construction (PPCV) modules 10 shown in FIG. 1 is manufactured in accordance with the steps set out in FIGS. 2*a* to 2*h*. The method involves manufacturing a first module 10*a* in the series 10 by performing the steps of:

(a) casting a slab 12 of a first module 10*a* in the series of modules 10;

(b) casting opposed walls 14*a*, 14*b* of the first module 10*a* on opposed sides 18*a*, 18*b* of the slab; and (c) casting a roof slab 16 on the opposed walls 14*a*, 14*b* of the first module 10*a*.

Figure 2A:
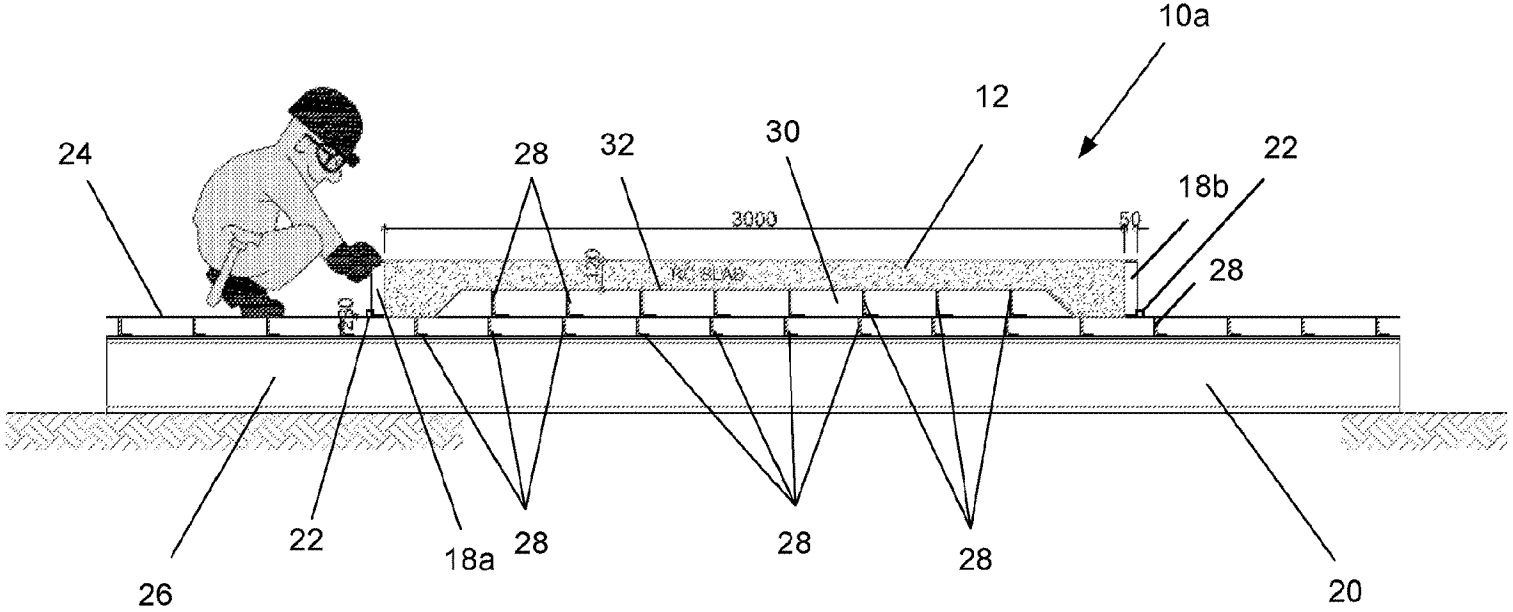
FIGS. 2*a* to 2*h* are diagrammatic illustrations showing the steps involved in constructing the modules shown in FIG. 1.

With reference to FIG. 2*a*, the step of casting the slab 12 of the first module 10*a* includes the steps of:

(a) positioning two steel plates 18*a*, 18*b* in spaced apart positions on the casting rig 20, the plates 18*a*, 18*b* defining end sections of formwork for the slab 12;

(b) securing the steel plates 18*a*, 18*b* in position using stopper 22;

(c) setting reinforcement bars into the formwork;

(d) pouring concrete into the formwork; and (e) allowing the slab 12 set.

The casting rig 20 includes any suitable configuration that facilitates soft fit of each module such that they can slide to allow for removal (positioning key 66 needs to be disengaged). To reduce friction, the casting rig 20 is either fitted with rollers or sitting on Teflon™ pads. For illustrative purposes, the casting rig is below described with reference to the rig 20 including a metal plate 24 separated from a base section 26 by a plurality of angle bar members 28.

The plate 24 and the angle bar members 28 are preferably 8 mm thick. The casting rig 20 also includes a raised section 30 that sits on top of the metal plate 24. The raised section 30 is defined by additional metal plate 32 separated from the plate 24 by additional angled bar members 24. The raised section 30 acts to create a recess in a bottom section of the slab 12 so as to reduce the weight of the slab 12 and the amount of concrete needed to be used.

The metal plates 18*a*, 18*b* are preferably 3000 mm apart. Alternatively, the plates 18*a*, 18*b* can be separated by any suitable distance to meet the requirements of a particular project. The plates 18*a*, 18*b* are preferably 8 mm thick and have a height of 230 mm. Again, any other suitable dimensions are anticipated to suit the needs of a particular project.

The resultant slab 12 has a thickness of 230 mm at its edges and a thickness of 120 mm at its centre. Any other thicknesses can also be achieved to meet any particular requirement.

Figure 2B:
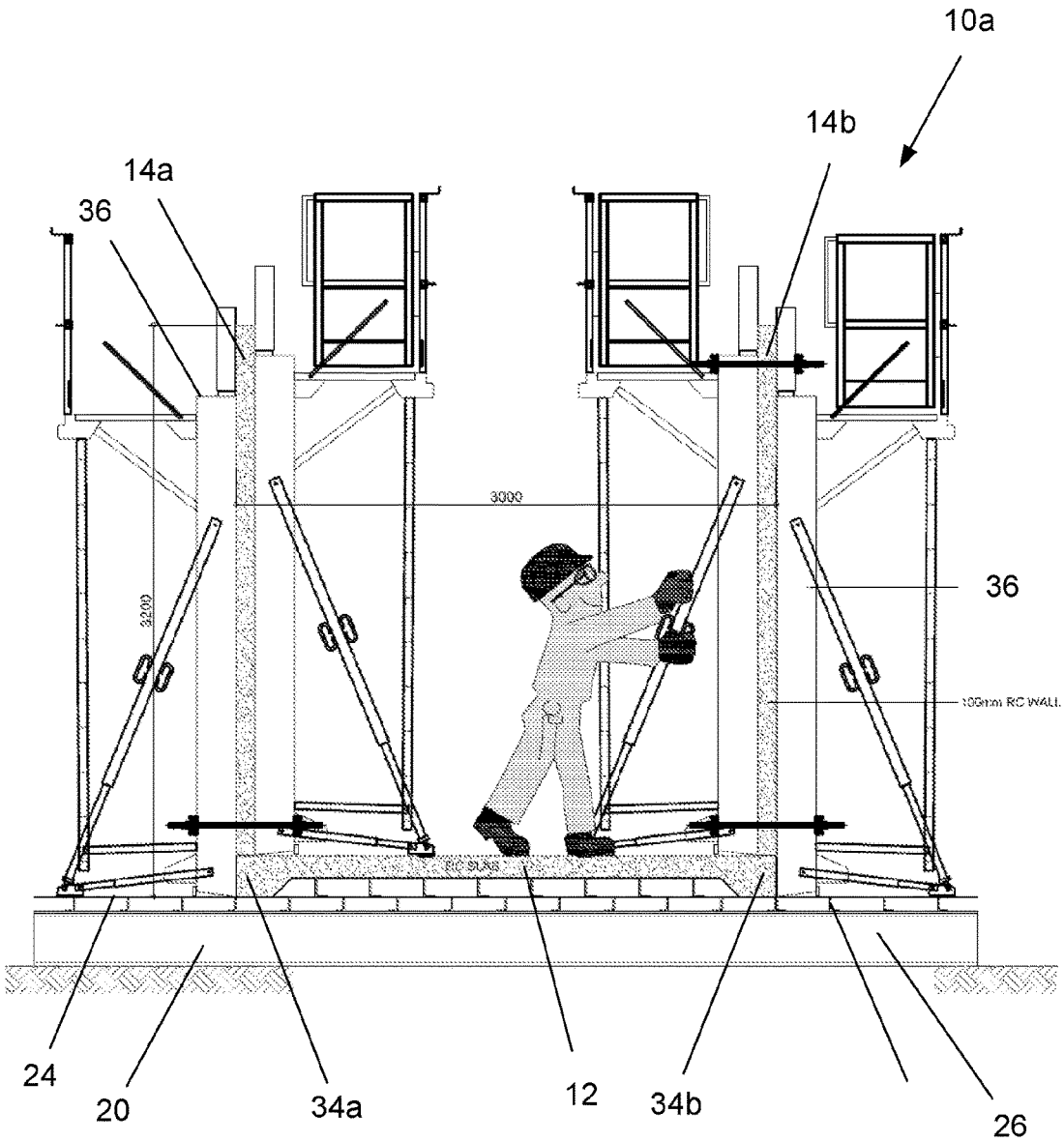

With reference to FIG. 2*b*, the walls 14*a*, 14*b* are constructed on opposed sides 34*a*, 34*b* of the slab 12. For each wall 14*a*, 14*b*, formwork 36 is set up using standard equipment and using known techniques. The close wall formwork panels are separated by a gap of 100 mm. This is for a 200 mm thick wall 14*a*, 14*b*. For a 250 mm wall 14*a*, 14*b* the setup will be with 125 mm (half of the wall thickness). This will be the resultant thickness of the walls. Of course, any other suitable thickness for the walls can be used. Reinforcement bars are included in the formwork to strengthen the walls 14*a*, 14*b*. The concrete is poured into the formwork 36 of each wall 14*a*, 14*b* to a height of 3200 mm, for example. Alternatively, any suitable alternative height for the walls 14*a*, 14*b* can be used. The formwork 36 remains in place whilst the concrete sets.

Figure 2C:
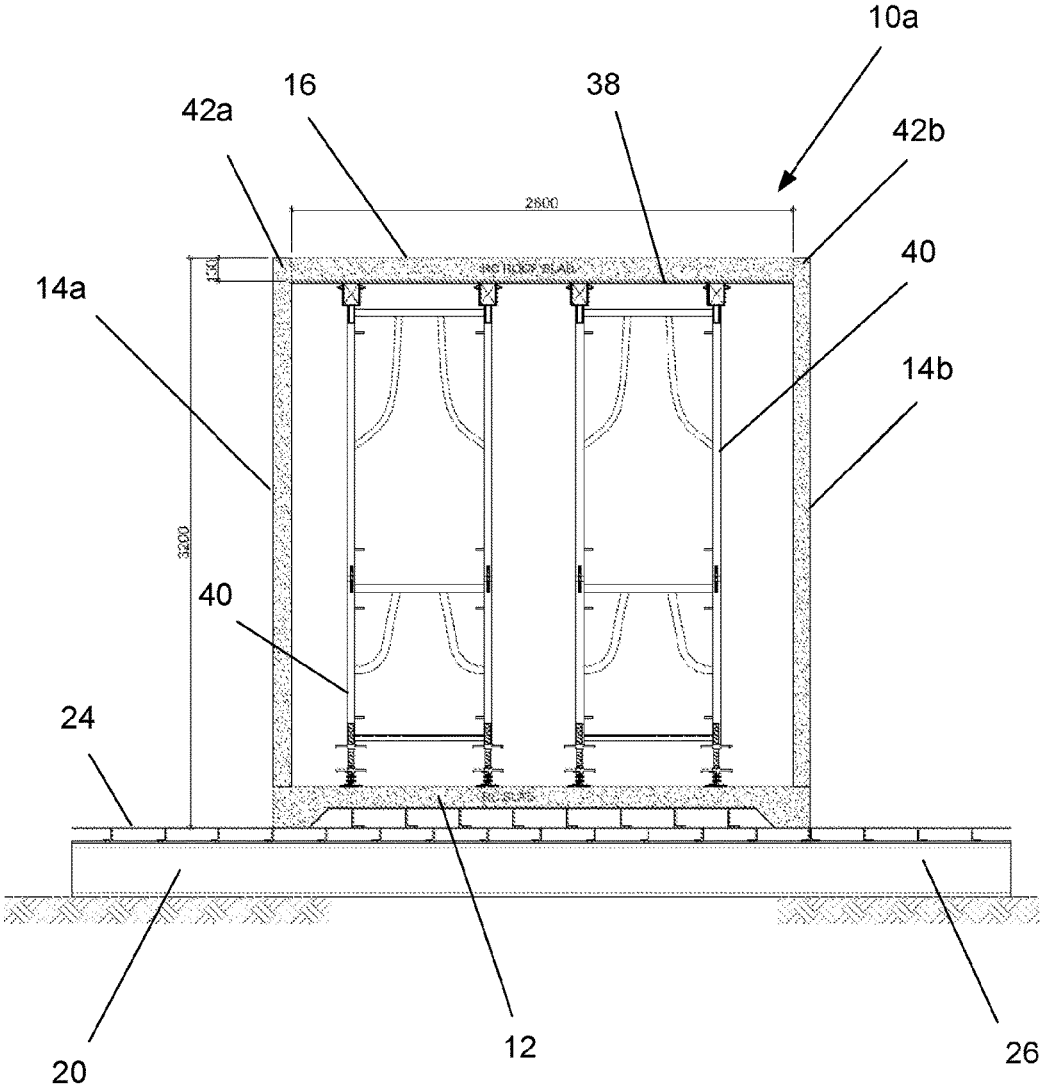

With reference to FIG. 2*c*, to create the roof slab 16, a metal plate 38 is suspended over the slab 12 by scaffold equipment 40. The plate 38 is positioned such that it creates a bottom surface for the formwork for the roof slab 16 and is bookended by top sections 42*a*, 42*b* of the walls 14*a*, 14*b*. Reinforcement bars are included in the formwork to strengthen the roof slab. Concrete is poured into the formwork to create the roof slab 16. The roof slab is preferably 130 mm. Alternatively, the roof can be of any other suitable thickness, or by using precast planks or any other suitable roofing system. The formwork remains in place whilst the concrete sets.

Following manufacture of the first module 10*a* in the series, the subsequent modules 10*b*, . . . are manufactured by following the steps set out below:

(a) casting a slab 12 of a new module 10*b* in the series of modules 10 against a slab 12 of the previous module 10*a* in the series of modules 10;

(b) casting opposed walls 14*a*, 14*b* of the new module 10*b* on opposed sides 18*a*, 18*b* of the slab 12, wherein one of the walls 14*a* is cast against a wall 14*b* of the previous module 10*a;*

(c) casting a roof slab 16 on the opposed walls 14*a*, 14*b* of the new module 10*b*, the roof slab 16 being cast against the roof slab 16 of the previous module 10*a;*

(d) separating the new module 10*b* from the previous module 10*a;*

(e) repeating steps (a) to (d) for each successive module in the series 10.

The side walls 14*a*, 14*b* of each module in the series 10 of modules are matched to corresponding side walls 14*a*, 14*b* of neighbouring modules in the series of modules 10.

Figure 2D:
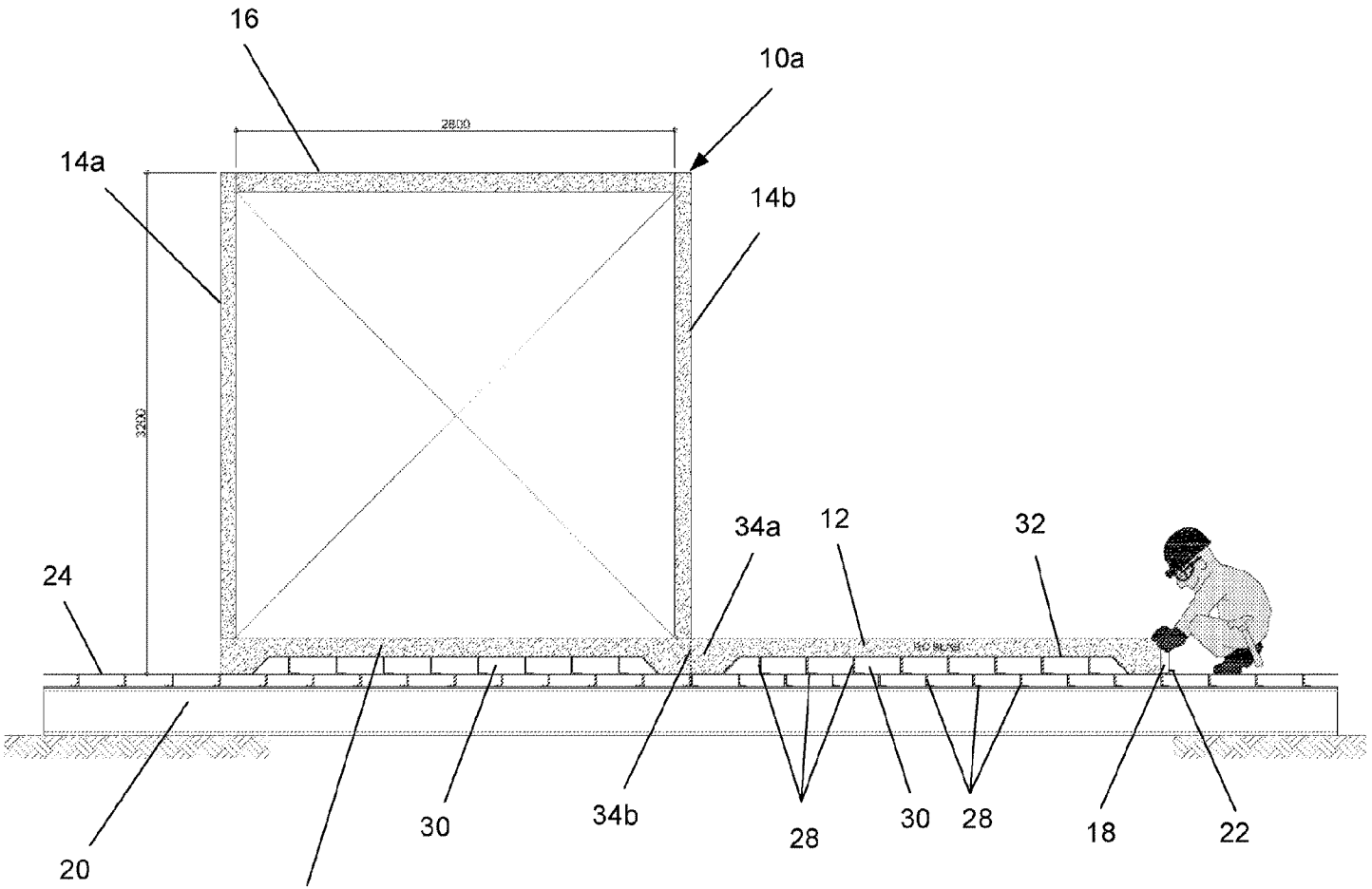

As particularly shown in FIG. 2*d*, the step of casting the slab 12 of the next successive module 10*b* in the series includes the steps of:

(a) positioning a steel plate 18 in a position on the casting rig 20 spaced apart from the slab 12 of the previous module 10*a* in the series, the end of the slab 34 of the previous module and the plate define formwork for the slab 12;

(b) securing the steel plate 18 in position using a stopper 22;

(c) setting reinforcement bars into the formwork;

(d) pouring concrete into the formwork; and (e) allowing the slab 12 set.

The casting rig 20 includes an additional raised section 30 that sits on top of the metal plate 24. The raised section 30 is defined by additional metal plate 32 separated from the plate 24 by additional angled bar members 24. The additional raised section 30 acts to create a recess in a bottom section of the slab 12 so as to reduce the weight of the slab 12 and the amount of concrete needed to be used. Any other thicknesses can also be achieved to meet any particular requirement.

The resultant slab 12 has a thickness of 230 mm at its edges and a thickness of 120 mm at its centre.

Figure 2E:
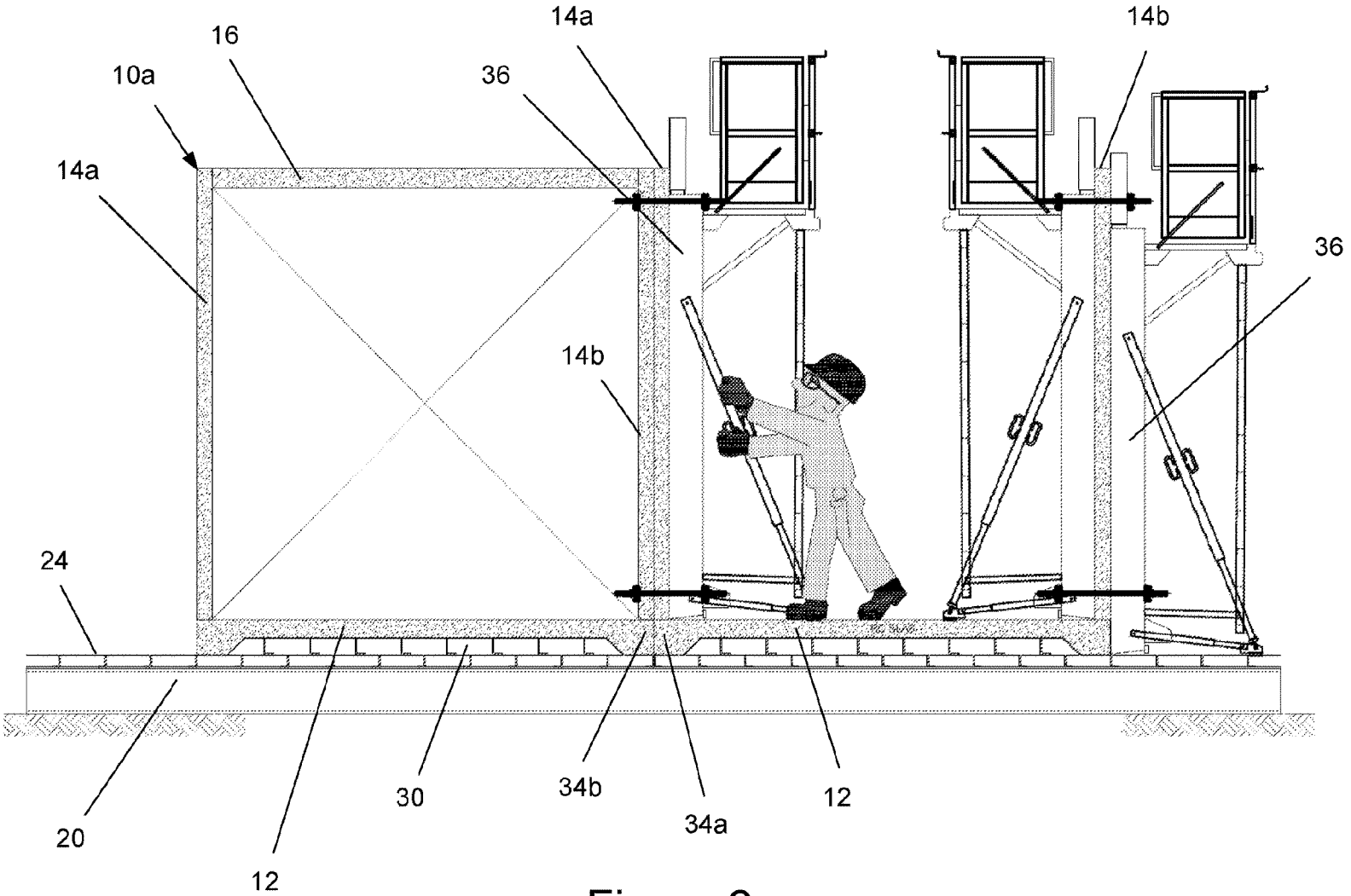

With reference to FIG. 2*e*, the walls 14*a*, 14*b* are constructed on opposed sides 34*a*, 34*b* of the slab 12. For each wall 14*a*, 14*b*, formwork 36 is set up using standard equipment and using known techniques. As shown, one of the walls 14*a* is cast against a wall 14*b* of the previous module 10*a*.

The close wall formwork panels are separated by a gap of 100 mm. This will be the resultant thickness of the walls. For a 250 mm wall 14*a*, 14*b*, the setup will be with 125 mm (half of the wall thickness).

Of course, any other suitable thickness for the walls can be used. Reinforcement bars are included in the formwork to strengthen the walls 14*a*, 14*b*. The concrete is poured into the formwork 36 of each wall 14*a*, 14*b* to a height of 3200 mm, for example. Alternatively, any suitable alternative height for the walls 14*a*, 14*b* can be used. The formwork 36 remains in place whilst the concrete sets.

Figure 2F:
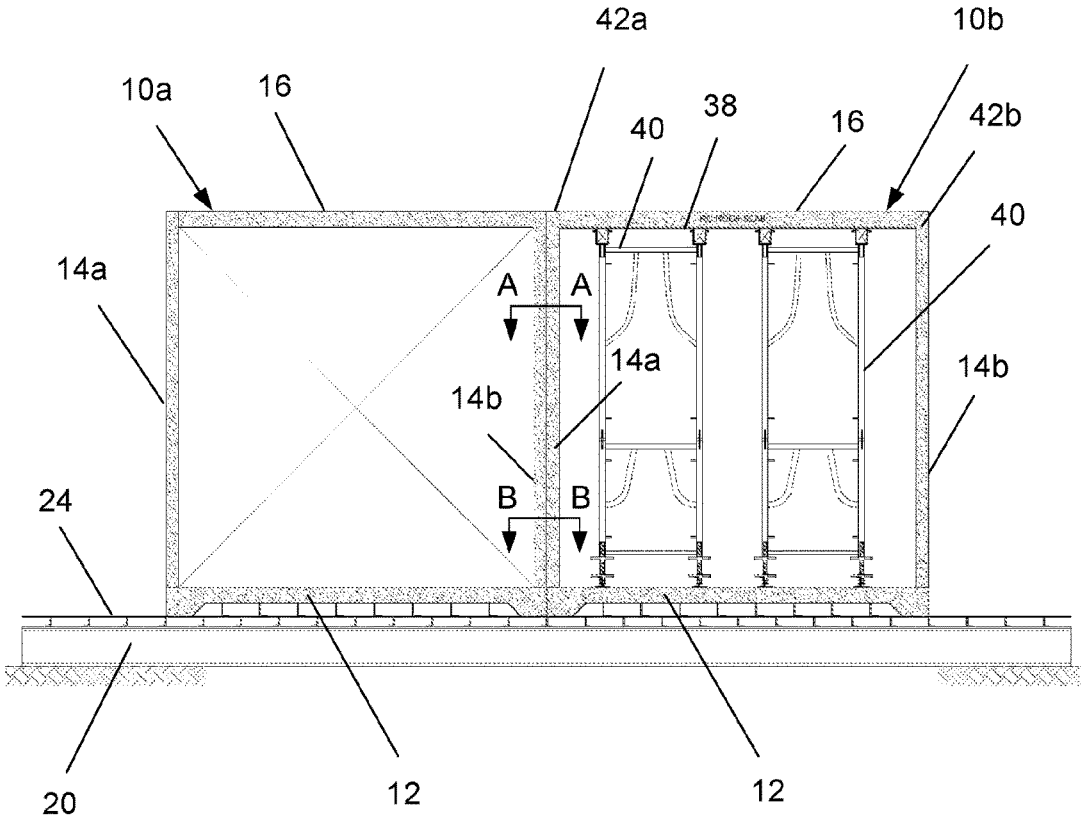

With reference to FIG. 2*f*, to create the roof slab 16, a metal plate 38 is suspended over the slab 12 by scaffold equipment 40. The plate 38 is positioned such that it creates a bottom surface for the formwork for the roof slab 16 and is bookended by top sections 42*a*, 42*b* of the walls 14*a*, 14*b*. Reinforcement bars are included in the formwork to strengthen the roof slab. Concrete is poured into the formwork to create the roof slab 16. The roof slab is preferably 130 mm. Alternatively, the roof can be of any other suitable thickness, or by using precast plank or any other suitable roofing system. The formwork remains in place whilst the concrete sets.

Figure 2G:
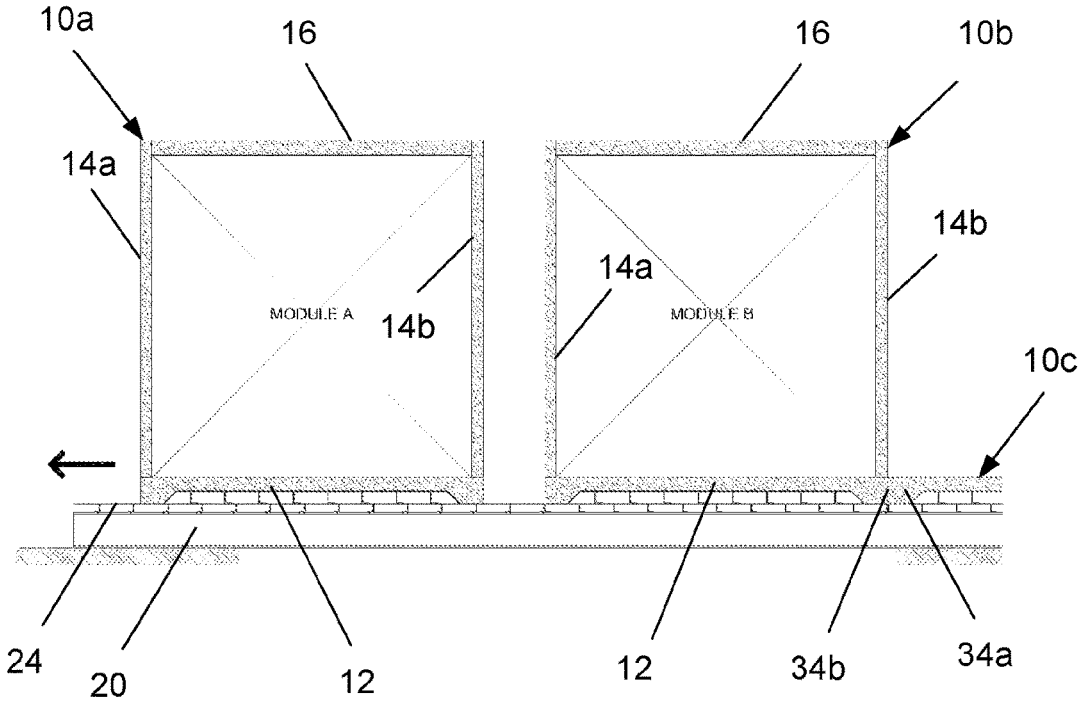

Finally, as shown in FIG. 2*g*, the modules 10*a*, 10*b* are separated on the Teflon coated track of the casting rig 20. Alternatively, the casting rig 20 includes any other suitable surface with a reduced co-efficient of friction so as to facilitate easy lateral translation of the modules thereacross.

In order to reduce the force required to separate the modules 10*a*, 10*b*, and in particular at the 100 mm thick wall area, the modules 10*a*, 10*b* preferably include polyethylene sheets 43. In this embodiment, the match cast surface for the walls 14*b*, 14*a* does not need to extend across the entire surface. Match cast is chiefly required at base 12 and top slab area 16, the vertical edges of the module 10 and around the vertical locks 50.

Figure 2H:
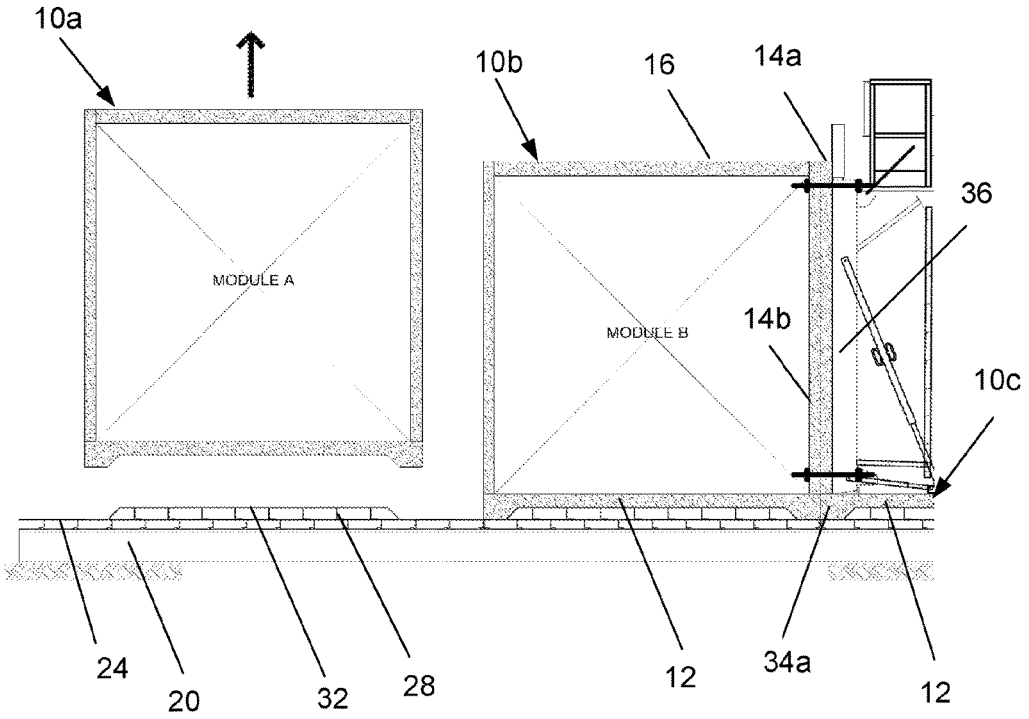
Figure 3A:
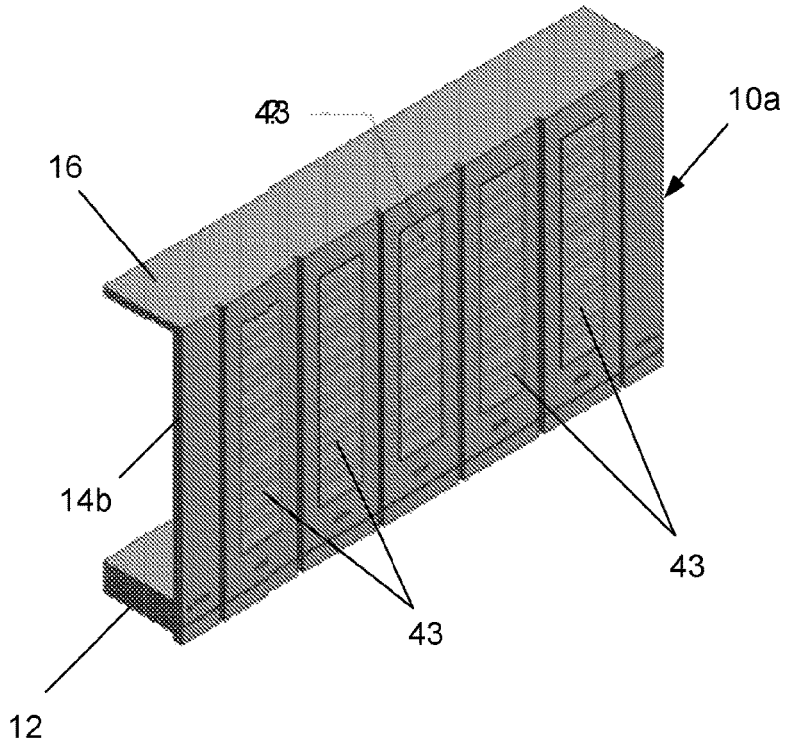
FIG. 3*a* is a side perspective view of a module formed in accordance with the steps shown in FIGS. 2*a* to 2*h;*
Figure 3B:
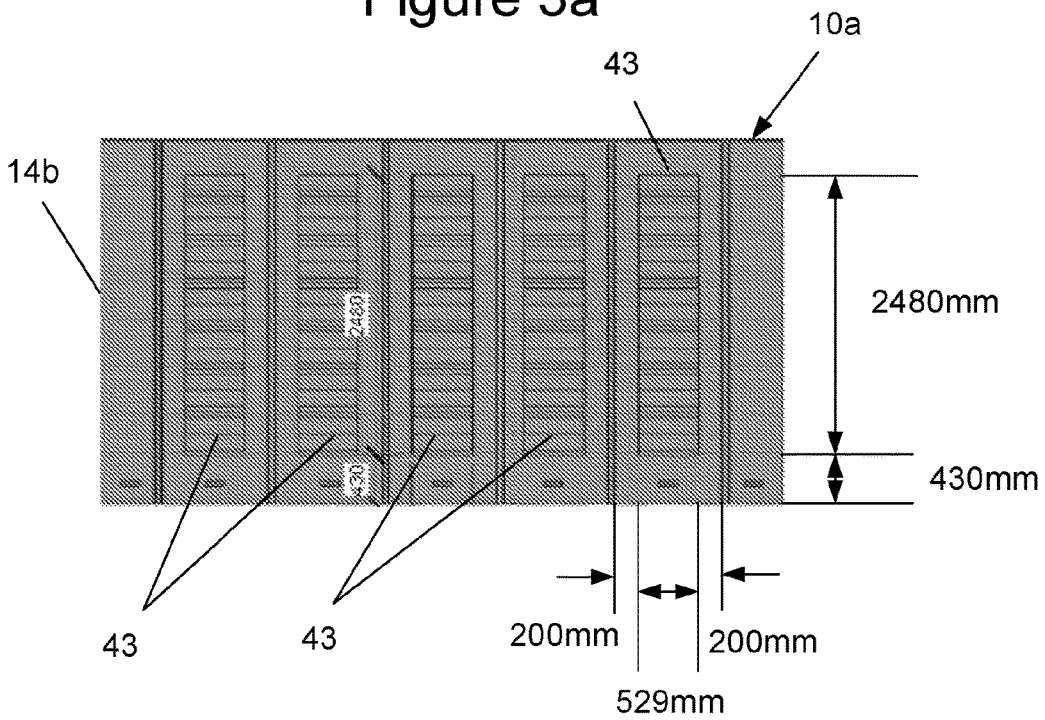
FIG. 3*b* is a side view of the module shown in FIG. 3*a;*

The first module 10*a* is taken away by a lifting module in the manner shown in FIG. 2*h* for installation at the construction site where the following steps are performed:

(a) positioning a first module in the series against a second module in e the series; and (b) coupling the first module and the second module together.

The above-described method improves upon issues relating to construction tolerance between elements by providing a perfect match when the elements are put back together. Furthermore, the above-described method ensures accurate finishing material continuity after erection.

The formwork is not described in detail. However, it is understood to include sophisticated formwork techniques, such as tunnel forms in which the walls and the ceiling slabs are poured simultaneously, could be used to speed up the fabrication process.

Assembly

The method of assembling the plurality of PPCV modules 10, includes the steps of:

(a) positioning a module 10*b* in the series of modules 10 against a matched previous module 10*a* in the series;

(b) coupling the module 10*b* and the previous module 10*a* together; and (c) repeating steps (a) and (b) for each successive module in the series 10.

It is desirable for the two half-walls 14*b*, 14*a* of adjoining modules 10*a*, 10*b* to be a monolithic member with a width equal to the sum of the thickness of the single elements. The vertical locks 50 on adjoining modules 10*a*, 10*b* facilitate this function in the manner shown in FIGS. 3 to 8.

Figure 4A:
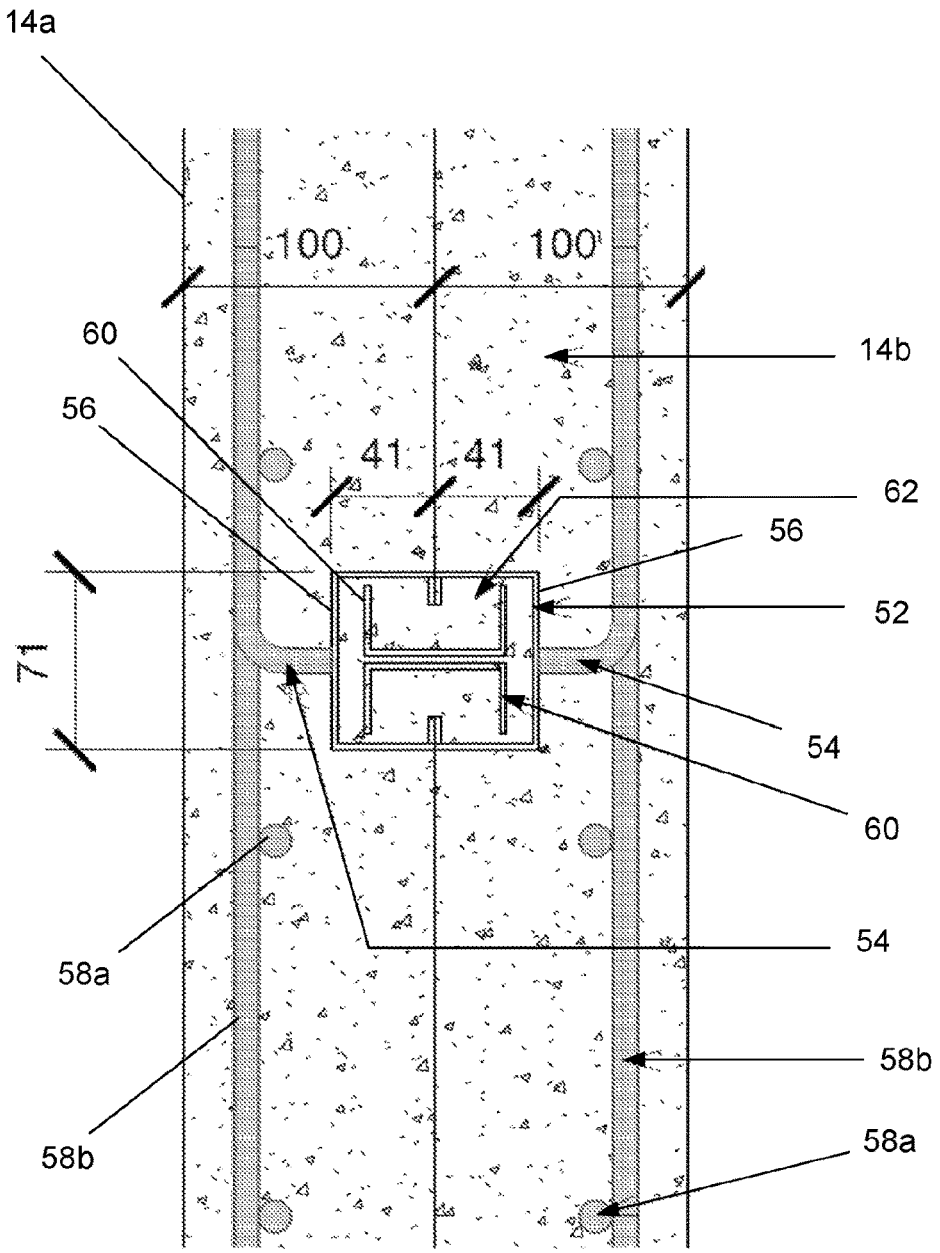
FIG. 4*a* is a section view through the line A-A of the modules shown in FIG. 2*f;*
Figure 7:
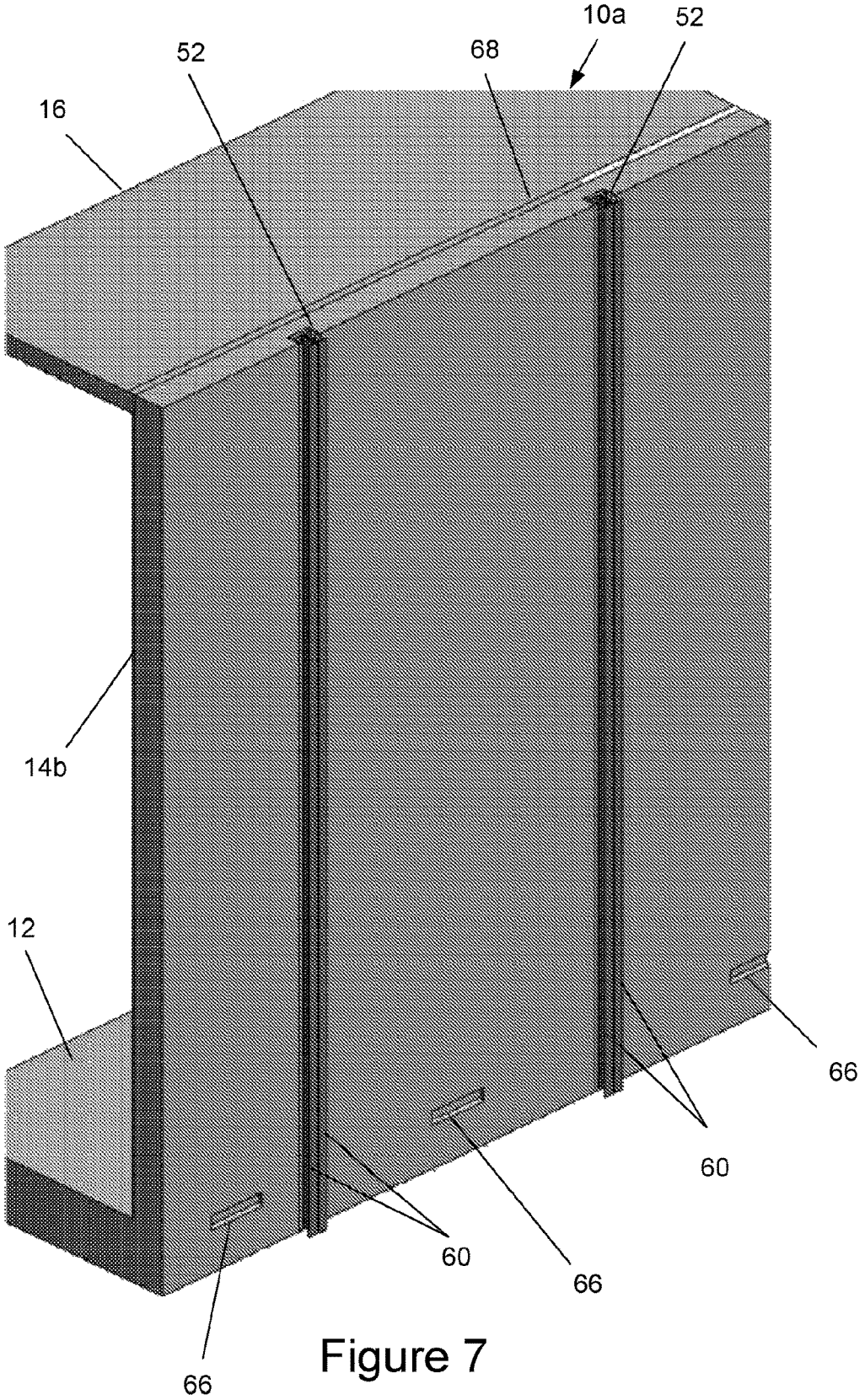
FIG. 7 is a side perspective view of one of the modules shown in FIG. 1.

As particularly shown in FIGS. 4*a* and 7, the locks 50 are formed using a lipped locking channel 52 positioned in the concrete walls 14*a*, 14*b*, on either side of the construction joint. The locking channels 52 are arranged to overly one another to form a combined locking conduit for the lock 50.

Studs 54 welded onto the steel section 56 forming the locks ensure the lock 50 is tied to the reinforcement bars 58*a*, 58*b* in each half wall 14*a*, 14*b*. To ensure the mechanical continuity of these locks 50, "C" channels 60 are inserted in the locks 50 and cement slurry 62 is poured into the internal volume to seal the various elements.

The lock 50 can also been formed using other types of steel sections 56 working in conjunction with grout 62. The grout 62 has the additional benefit of protecting the steel section against corrosion to ensure the system durability.

The locks 50 preferably span the entire wall height and form a mechanical connection between the two half-walls 14*b*, 14*a* of adjoining modules. The locks 50 replace the links or stirrups found in conventional reinforced concrete construction. The locks 50 also ensure the horizontal mechanical continuity of the slab 12 (diaphragm) that is required to transfer the horizontal forces to the various resisting members.

Figure 4B:
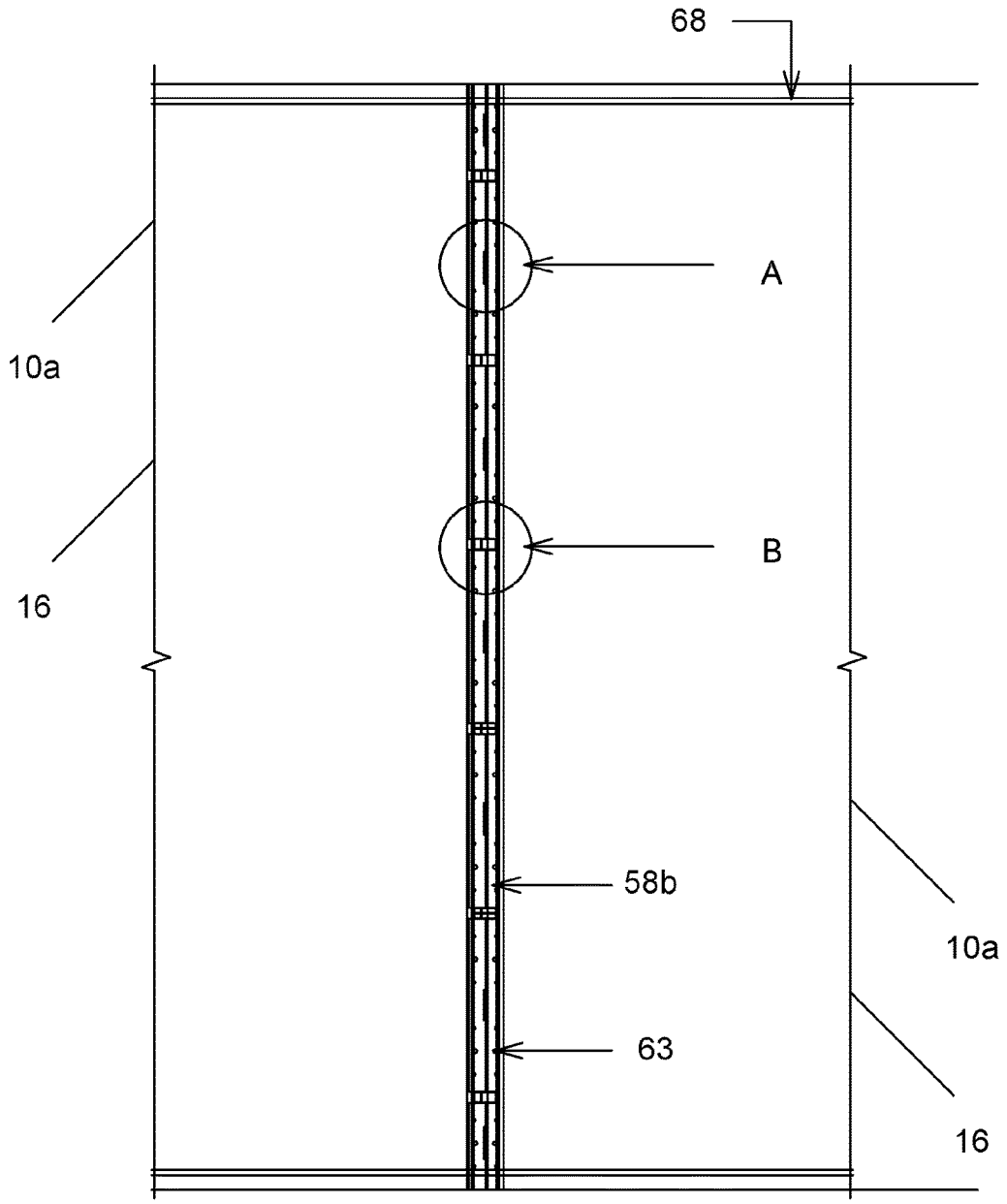
FIG. 4*b* is a plan view of the modules shown in FIG. 2*f* including an alternative lock arrangement.
Figure 4C:
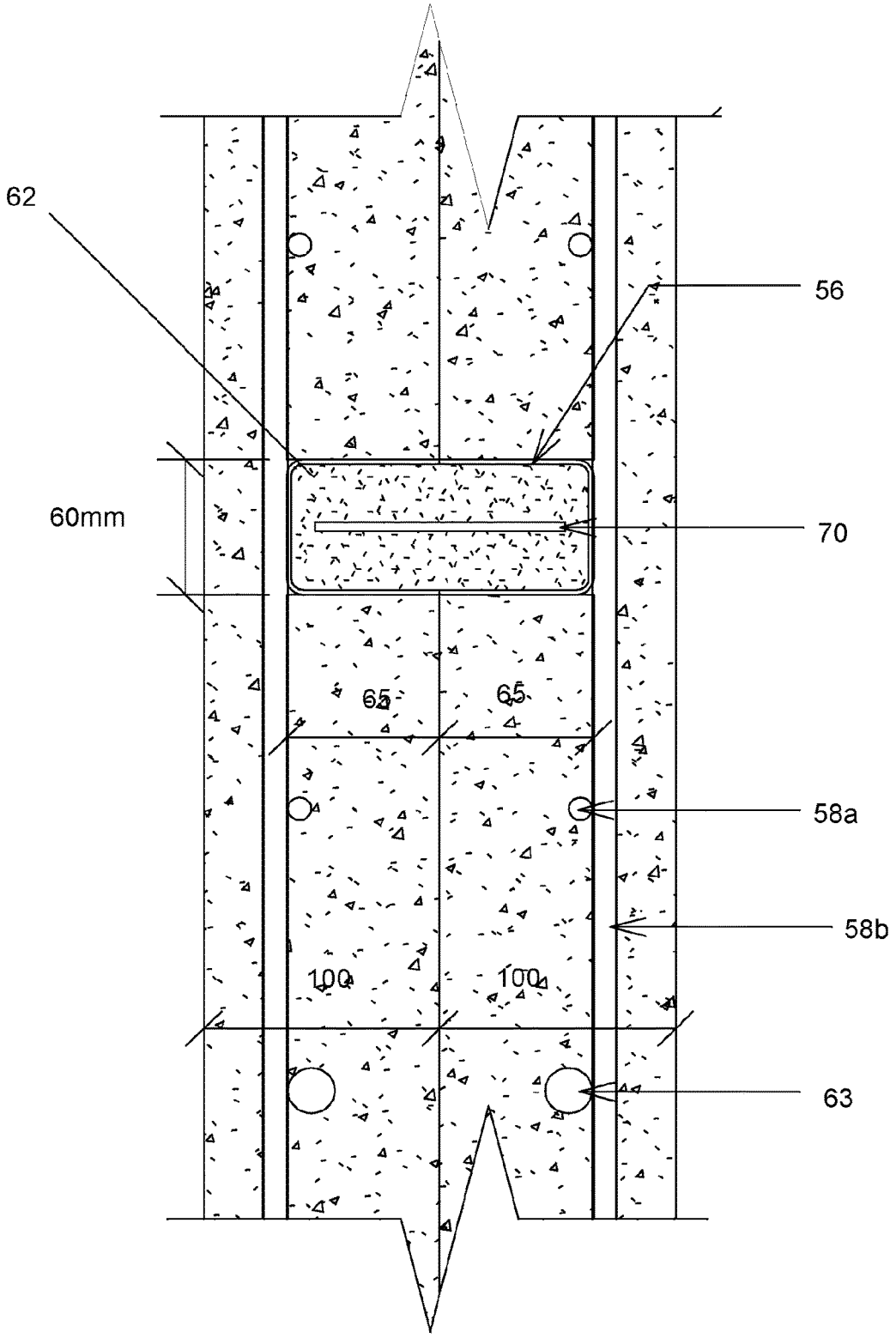
FIG. 4*c* is an enlarged view of detail B shown in FIG. 4*b;*
Figure 4D:
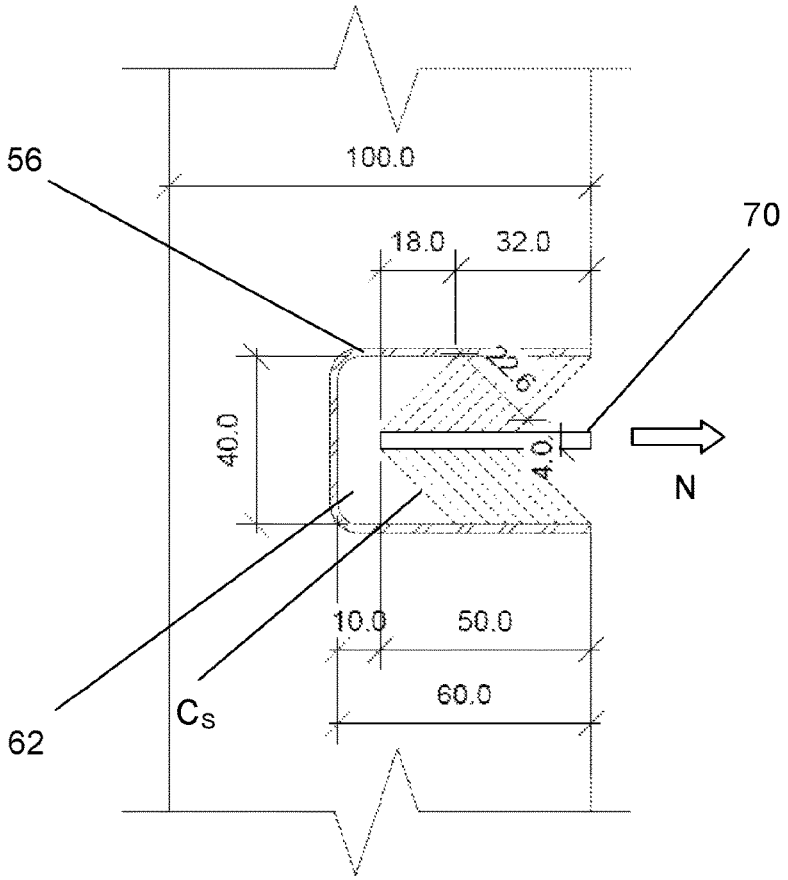
FIG. 4*d* is an enlarged view of the grouted lock shown in FIG. 4*c* showing compression stress lines formed when a force is applied to separate the walls of the module.

As shown in FIGS. 4*b* to 4*d*, the "U" shaped channels can alternatively include a flat bar 70. For this solution the U channel 56 is welded to the rebar cage 58*a*, 58*b*. The tying force required to keep the two sections of the wall 14*b*, 14*a* monolithic depends on:

(a) the wall thickness;

(b) free length; and (c) the gravity force applied onto it.

In the following calculation note, in order to assess the performance of the lock 50, this effort is taken as 40 t/m$^2$ (the magnitude of this effort is greatly overestimated).

It is also assumed that locks 50 are spaced 1 m center to center, giving a pulling effort of 0.4 MN/m.

Estimation of the Stress in the Flat Bar (For 1 m Length of Lock)

Considering:

As as the sectional area of the bar 70:

As=0.004.1 m=0.004 m$^2$

N as the pulling force applied on the lock:

N=0.4 MN

We get a tension stress in the steel member of:

$$\sigma s = \frac{N}{As} = \frac{0.4}{0.004} = 100 \text{ MPa}$$

This is to be compared to $\overline{\sigma}$ as tensile resistance of the steel:

$$\overline{\sigma}_s = 235 \text{ MPa}$$

Calculation of the Compressive Stress in the Grout Struts

We consider that the tension effort is transferred between the flat bar 70 and the U channel 56 by struts that are developing in the grout orientated with a 45° angle as shown in FIG. 4*d*.

Considering a pulling effort N of 0.4 MN, we can define the compressive stress in the grout as:

Compressive force in the strut:

$$Ns = \frac{N}{2} \cdot \frac{1}{\cos 45°} = \frac{0.4}{2} \cdot \frac{2}{\sqrt{2}} = 0.28 \text{ MN}$$

Stress in the grout strut $$\sigma g = \frac{Ns}{Ag} = \frac{0.28}{0.0226} = 12.51 \text{ MPa}$$

Where Ag is the strut sectional area:

$$Ag = 0.032 \cdot \cos 45° = 0.0226 \text{ m}^2$$

This is to be compared to the compressive resistance to the grout 62 that we take as:

$$\bar{\sigma}_g = 80 \text{ MPa}$$

Friction of Between the Bar/U Channel and the Grout Strut

The friction stress between the steel surface and the grout is given by:

$$\tau = \frac{N}{2} \cdot \frac{1}{A} = \frac{0.40}{2} \cdot \frac{1}{0.032} = 6.25 \text{ MPa}$$

Where:

N is the pulling strength N=0.4 MN

A is the contact area between the strut and the steel surface A=0.032 $m^2$

This is to be compared to the allowable shear stress:

$$\bar{\tau} = 0.6 \cdot \psi^2 \cdot ft + 0.4\ \sigma c = 0.6 \cdot 7.65 + 0.4 \cdot 6.25 = 7.09 \text{ MPa}$$

Where:

ψ is a coefficient depending on the steel roughness. ψ=1 when no roughness ft is the traction resistance of the grout taken as ft=7.65 Mpa σs is the compression stress "$C_s$" applied at the interface steel/grout resulting from the 45° strut angle. It is equal to:

$$\sigma s = \frac{N}{2} \cdot \frac{1}{A} = \frac{0.4}{2} \cdot \frac{1}{0.032} = 6.25 \text{ MPa}$$

Figure 4E:
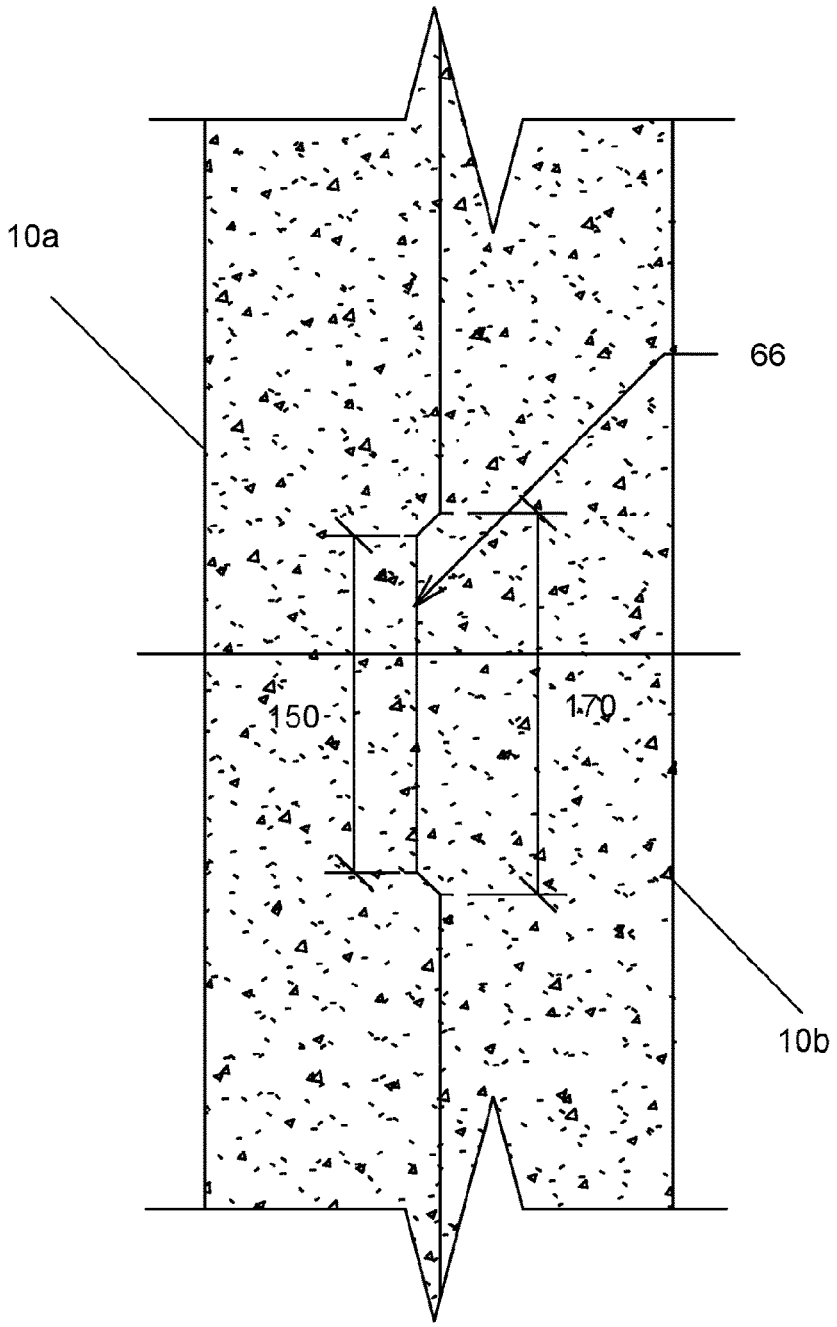
FIG. 4*e* is an enlarged view of detail A shown in FIG. 4*b;*

As shown in FIGS. 4*c* and 4*e*, the modules 10*a*, 10*b* include T20-500 (Dowel Bars) 63 extending therethrough. This provides additional structural integrity to the modules 10.

Figure 5A:
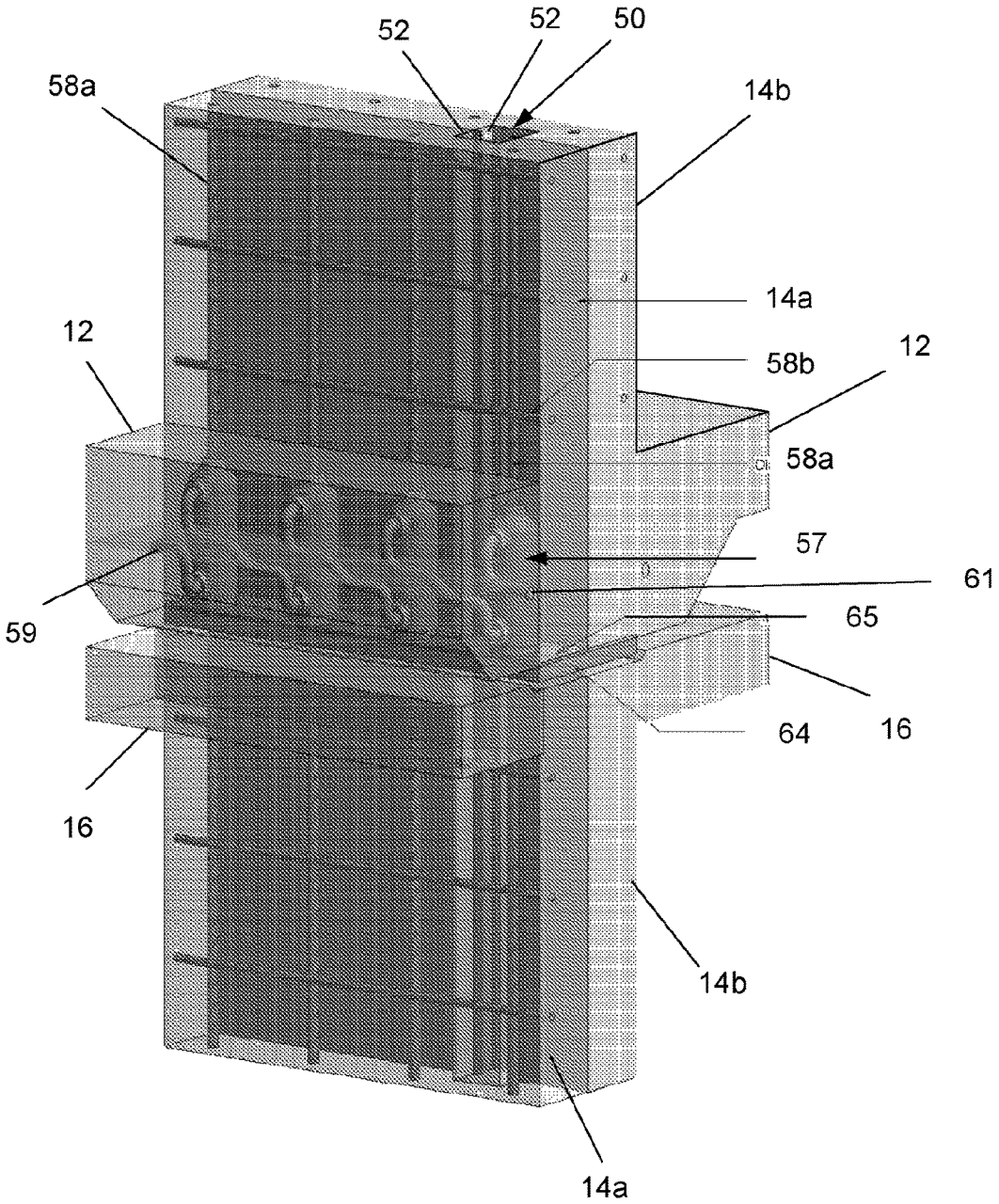
FIG. 5*a* is a diagrammatic illustration of an intersection of the four modules shown in FIG. 1.
Figure 5B:
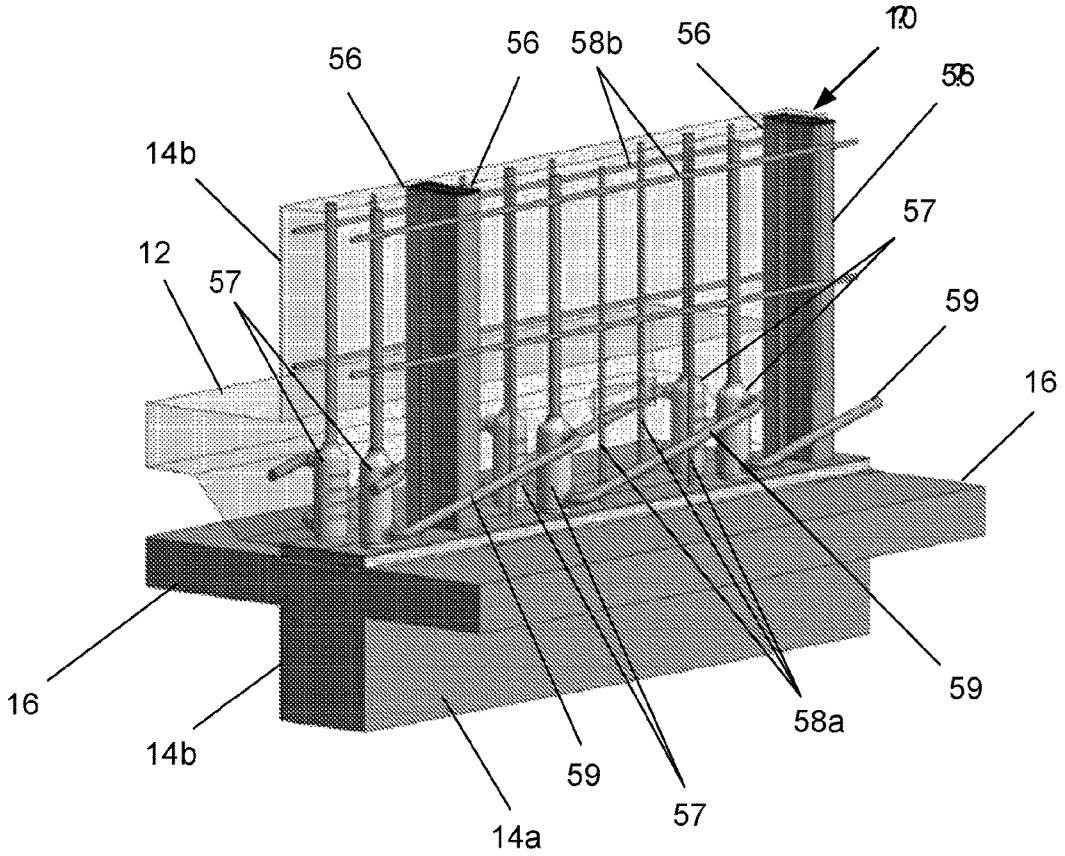
FIG. 5*b* is another diagrammatic illustration of the intersection of the four modules shown in FIG. 5*a* featuring different couplers and rebar cage arrangement.
Figure 6:
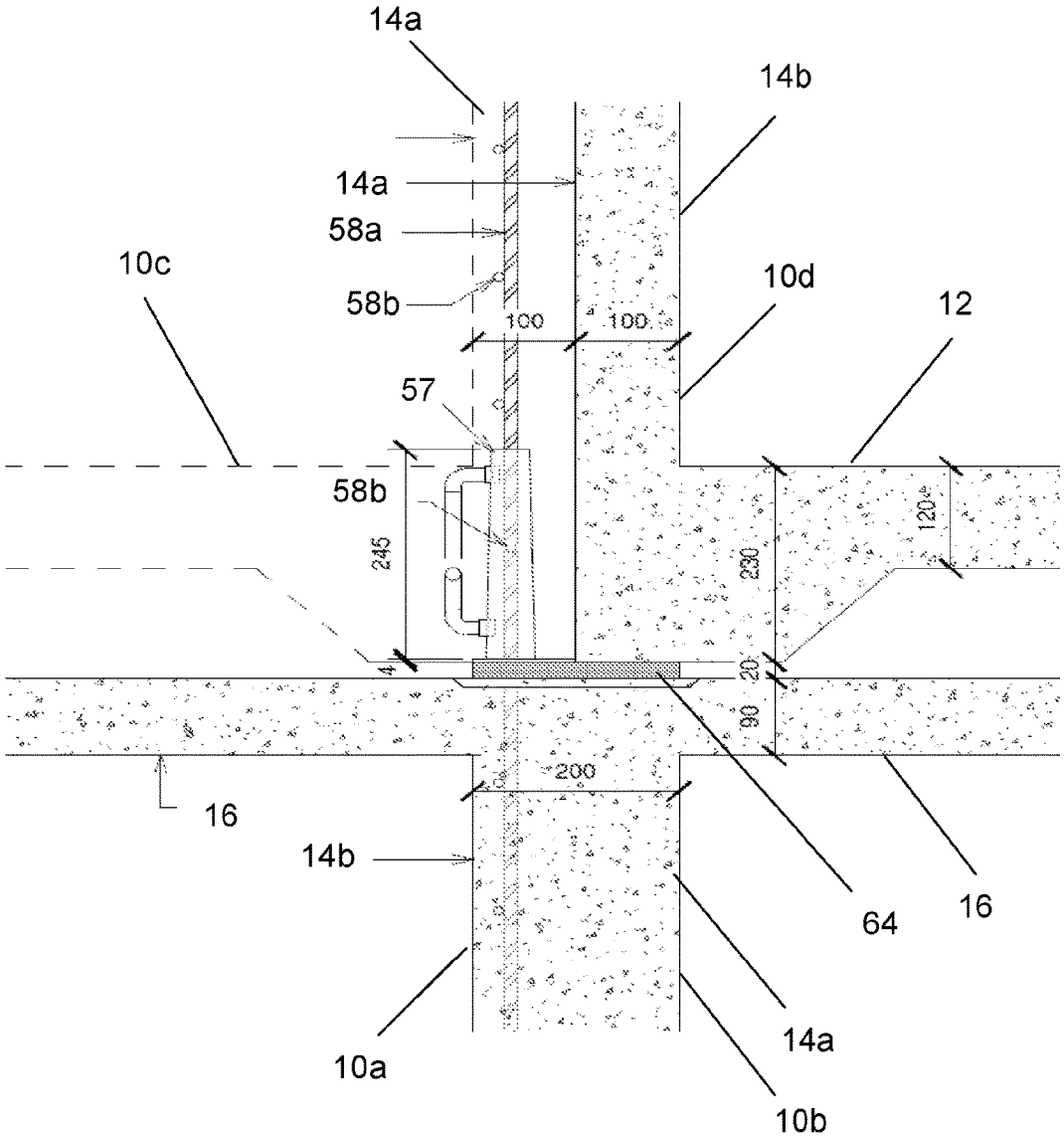
FIG. 6 is a section view of the of the intersection of the four modules shown in FIG. 1.

As shown in FIGS. 5*a*, 5*b* and 6, grouted connectors 57 provide continuity of vertical bars 58*a* between vertically stacked modules 10*a*, 10*c*. The grouted connectors 57 are interconnected by conduits 59. The grouted connector sleeves 57 are spaced at 150 mm c/c or any distance meeting the structural design requirement.

The connector 57 are pre-positioned in the formwork before the module pouring. This sleeve 57 consist of a steel tube in which vertical rebars 58*a* from the upper and lower modules 10*a*, 10*c* are located and are abutting. The continuity is achieved by pouring grout that will transfer a load from the rebar 58*a*, to the sleeve 57, and then from the sleeve 57 to the other rebar 58*a*. The grouting is achieved by pumping grout in the injection port 61 that is located at the base of the connector, until it escape from the venting port that is located at the top of the connector. In our case, as the grouting will be performed for a series of connectors, we will connect the venting port to the injection port of the next connector.

Epoxy glue will be preferably be applied to the match cast surface. This has at least the following benefits:

(a) Gluing of the modules;

(b) Lubricate the element to ease the accurate positioning when applying the prestressing force; and (c) Ensure tightness for the grouting operation of the vertical locks.

Figure 8:
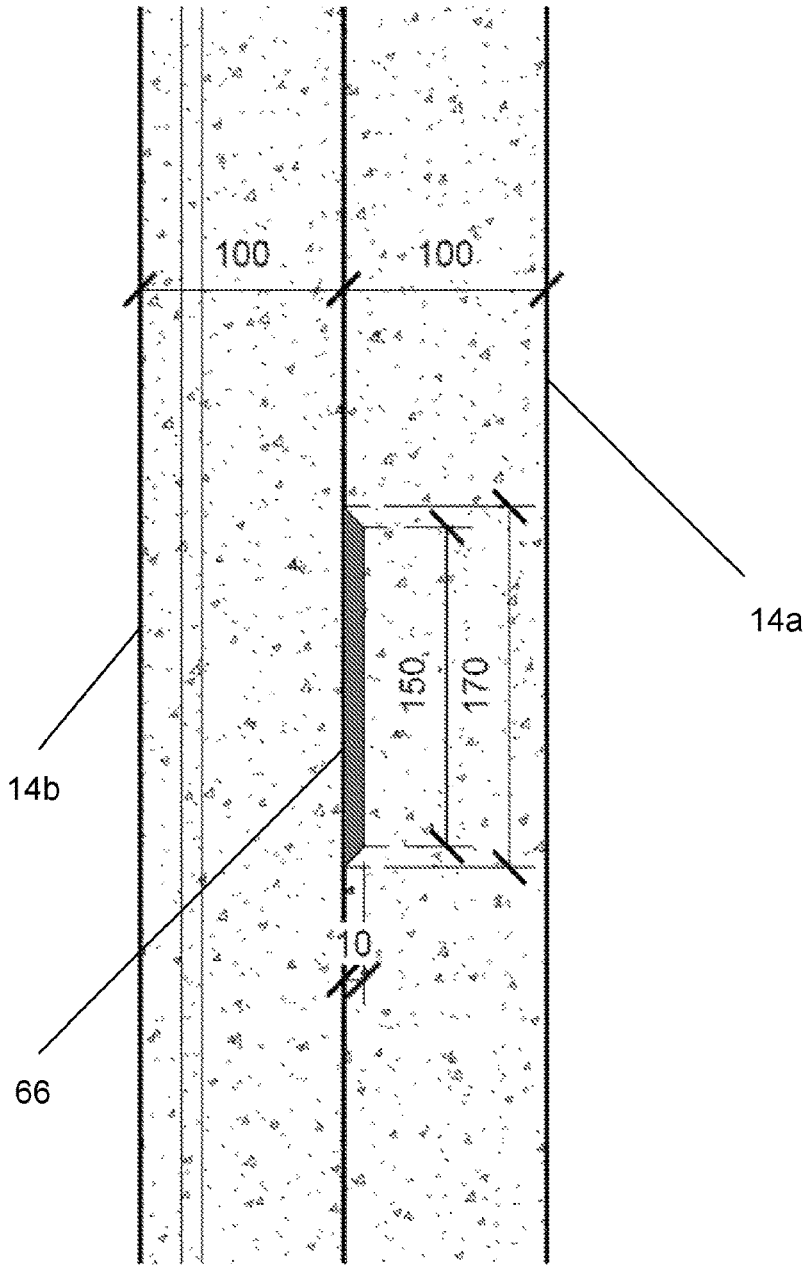
FIG. 8 is a section view through the line B-B of the modules shown in FIG. 2*f;*
Figure 9:
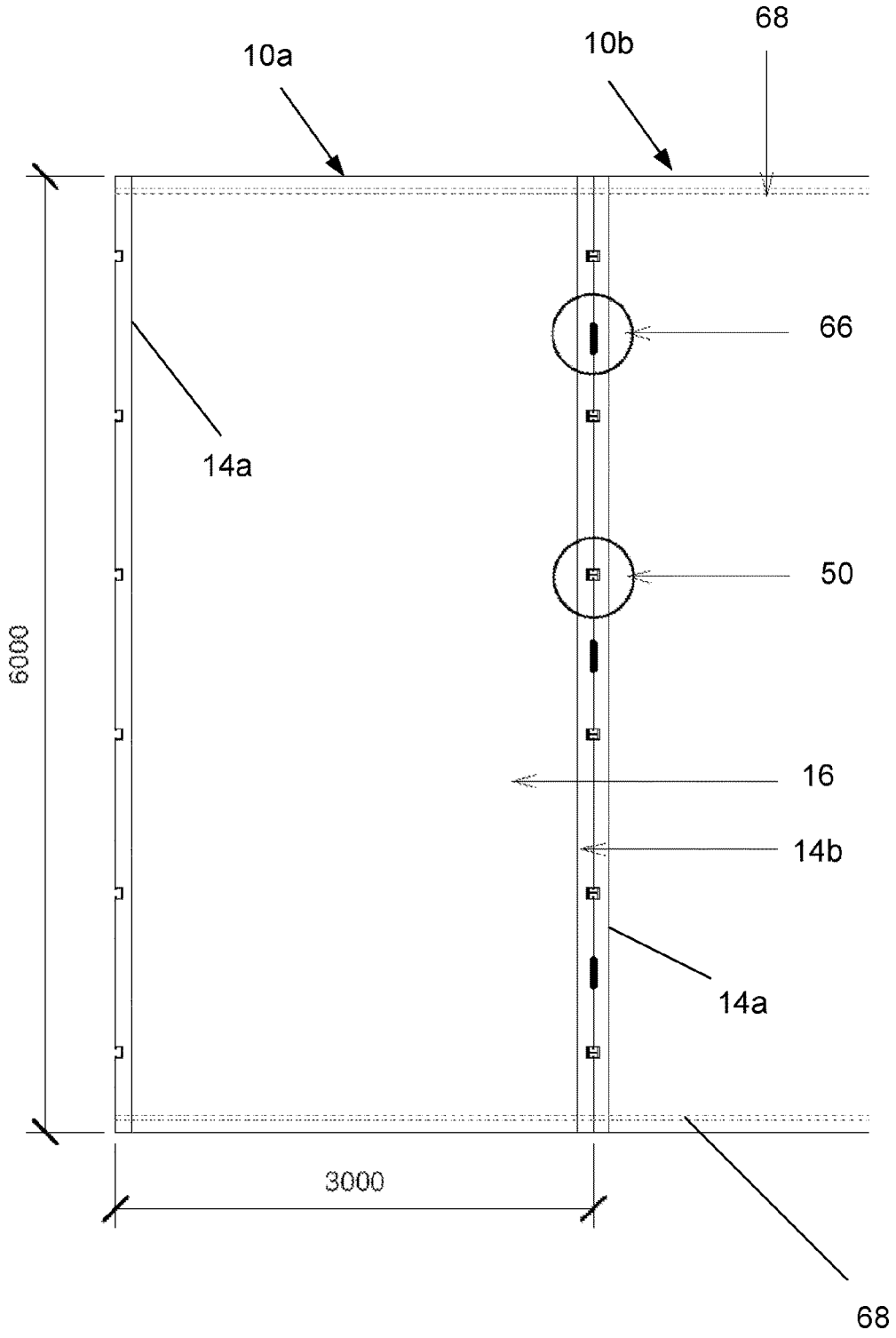
FIG. 9 is a plan view of the modules shown in FIG. 2*f;*

With reference to FIG. 6, the transfer of vertical forces between modules 10 is done through a 20 mm thick metal plate 64 that is also used to ensure the leveling of the module. This steel plate 64 is accurately positioned on top of the modules 10 that have been installed at the lower floor by grouting. This plate 64 works in conjunction with a 4 mm metal plate 65 embedded in the lower part of the upper module so as to have steel to steel bearing during installation. This 4 mm thick plate 65 is also used to accurately position the connectors during the module fabrication by tack welding them on the steel member. This thickness may vary depending on the application. AS shown in FIGS. 8 and 9, during installation, to ensure proper relative positioning of the elements, centering keys 66 are provided on the lateral faces of the modules 10.

To ensure key 66 effectiveness for the accurate positioning of modules 10 in relation to one another, a compression force must be applied between the modules 10. This is achieved through a pre-stressing cable positioned in a duct 68 installed in the slab 12 of the module floor. Other methods can also be used to apply the force, such as using hydraulic jacks fixed on the roof of the modules already installed. This operation is done in order to achieve very accurate positioning of a module 10*b* in relation to an adjacent module 10*a* that is already placed. To be efficient, this compression force needs to be applied in order for the positioning key 66 to engage and displace the module 10*b* sideway if not align satisfactorily.

Figure 10A:
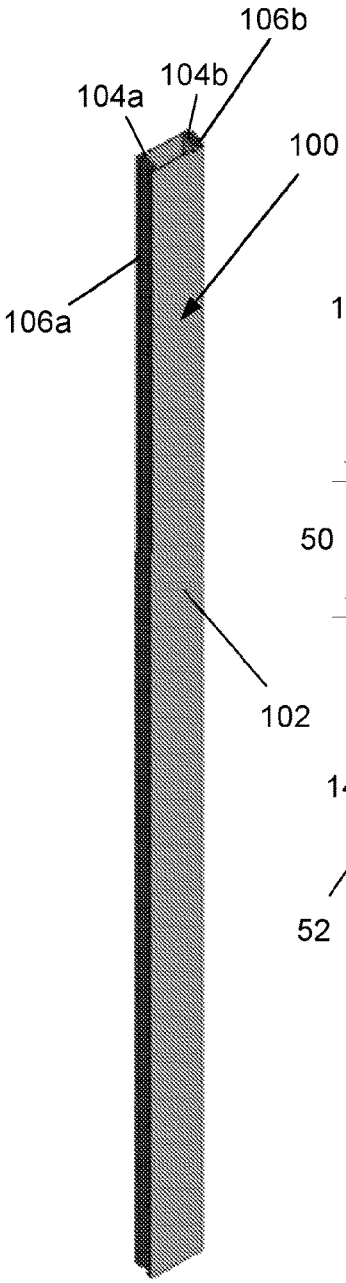
FIG. 10*a* is a side perspective view of separation apparatus.
Figure 10B:
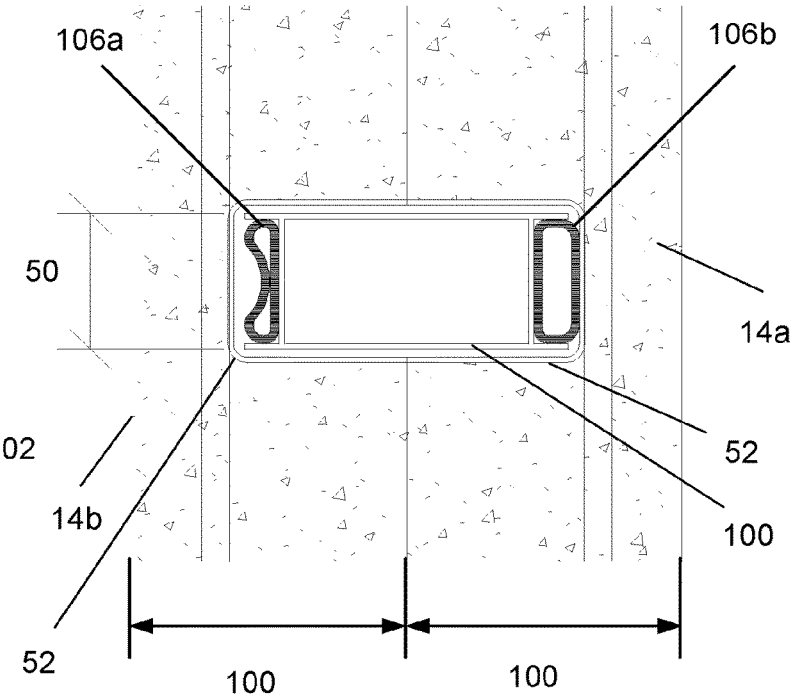
FIG. 10*b* is a section view through the line A-A of the modules shown in FIG. 2*f* with the separation apparatus of FIG. 10*a* seated in the channels of the abutting modules.

To facilitate easier separation of matched modules during the module construction phase, separation apparatus 100 can be inserted into the locking channels 52. As shown in FIGS. 10*a* and 10*b*, the apparatus 100 includes an elongate shaft 102 which is generally rectangular in cross-section. Short sides of the shaft include opposed "U" shaped recesses 104*a*, 104*b* which each include seated therein inflatable balloons (also referred to as seals) 106*a*,106*b*.

The balloons 106*a*, 106*b* are connected to a pneumatic or fluid pump which, when activated, cause the balloons 106*a*, 106*b* to inflate outwardly in opposite directions from their respective recesses 104*a*, 104*b*. The inflating balloons 106*a*, 106*b* abut respective channels 52 and apply a force thereto in the direction in which they are inflating (i.e. away from their recesses 104*a*, 104*b*). Continued inflation thereby causes the channels 52 of the two module 10*a*, 10*b* to move in opposite directions and separate.

Figure 11A:
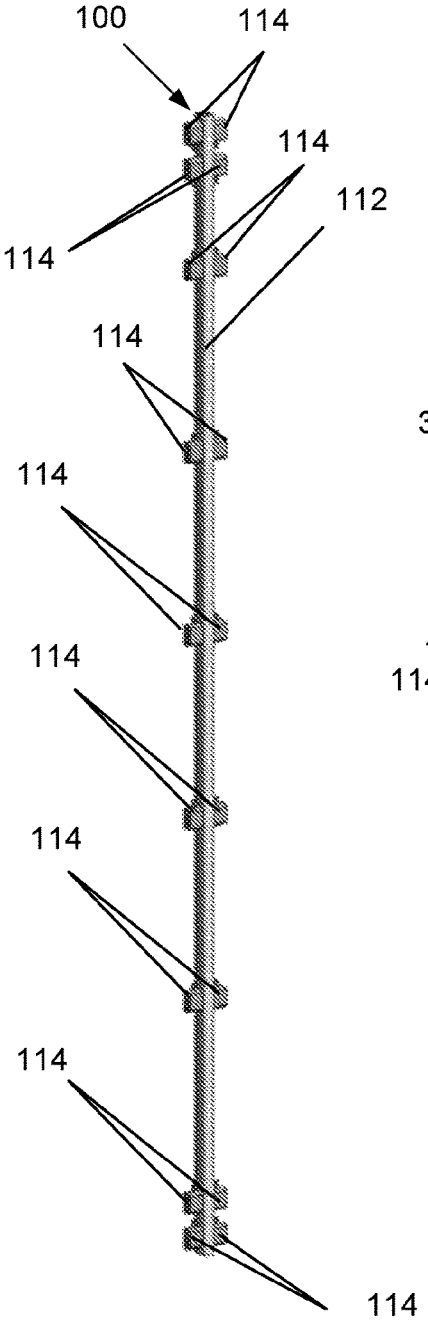
FIG. 11*a* is a side perspective view of alternative separation apparatus.
Figure 11B:
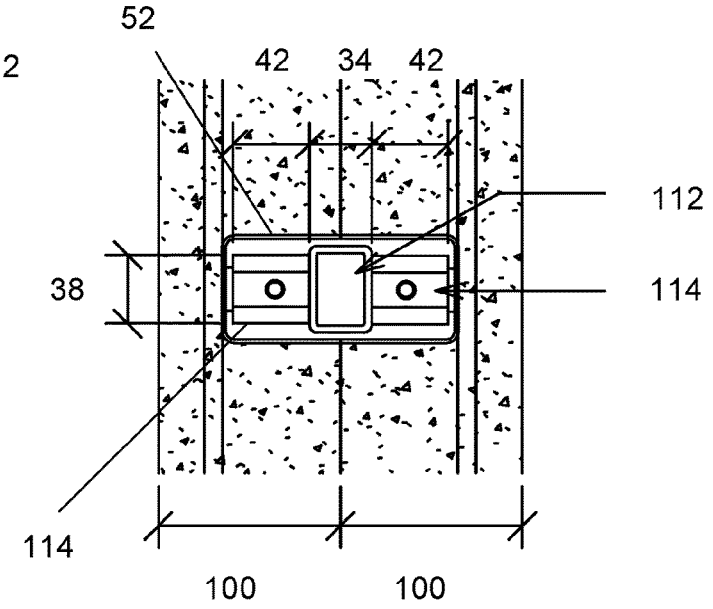
FIG. 11*b* is a section view through the line A-A of the modules shown in FIG. 2*f* with the alternative separation apparatus of FIG. 11*a* seated in the channels of the abutting modules.

An alternative embodiment of the separation apparatus 100 is shown in FIGS. 11*a* and 11*b*. The apparatus 100 includes an elongate shaft 112 which is generally rectangular in cross-section. The apparatus 100 includes pairs of hydraulic jacks 114 located in spaced apart positions along the length of the shaft 112.

The pairs of jacks 114 are connected to a pump which, when activated, cause the jacks to expand outwardly in opposite directions. The expanding jacks 114 abut respective channels 52 and apply a force thereto in the direction in which they are expanding (i.e. away from the shaft 112). Continued expansion thereby causes the channels 52 of the two module 10*a*, 10*b* to move in opposite directions and separate.

Many modifications will be apparent to those skilled in the art without departing from the scope of the present invention The reference to any prior art in this specification is not, and should not be taken as, an acknowledgment or any form of suggestion that the prior art forms part of the common general knowledge in Australia, Singapore or any other jurisdiction.

In this specification and the claims that follow, unless stated otherwise, the word "comprise" and its variations, such as "comprises" and "comprising", imply the inclusion of a stated integer, step, or group of integers or steps, but not the exclusion of any other integer or step or group of integers or steps.

References in this specification to any prior publication, information derived from any said prior publication, or any known matter are not and should not be taken as an acknowledgement, admission or suggestion that said prior publication, or any information derived from this prior publication or known matter forms part of the common general knowledge in the field of endeavor to which the specification relates.

The invention claimed is:

1. A method of manufacturing a series of prefabricated prefinished volumetric construction (PPCV) modules, including the steps of:

(a) casting a slab of a new module in the series of modules against an adjoining slab of a previous module in the series of modules;

(b) casting opposed walls of the new module on opposed sides of the slab to form side walls, wherein one of said side walls is cast against an adjoining wall of said previous module;

(c) casting a roof slab on said opposed walls of the new module, the roof slab being cast against an adjoining roof slab of said previous module;

(d) separating the new module from the previous module;

(e) repeating steps (a) to (d) for each successive module in the series, wherein the side walls of each module in the series of modules are matched to side walls of neighboring modules in the series of modules.

2. The method claimed in claim 1, including the steps of:

(a) casting a slab of a first module in the series of modules;

(b) casting opposed walls of the first module on opposed sides of the slab; and (c) casting a roof slab on said opposed walls of the first module.

3. The method claimed in claim 1, wherein one or more vertically extending locking channels are cast into outer articular surfaces of the side walls of each module.

4. The method claimed in claim 3, wherein the locking channels span an entire wall height of the walls of each module.

5. The method claimed in claim 3, wherein the locking channels of each module are lipped.

6. The method claimed in claim 5, wherein the lipped channels are coupled to studs of reinforcement bars installed in the walls of the modules during the casting step.

7. The method claimed in claim 1, wherein the walls of the modules are keyed to assist in accurate positioning of modules in relation to one another.

8. The method claimed in claim 1, wherein the modules each include a lateral duct for carrying a pre-stressing cable therethrough that is used to apply horizontal mating forces.

9. The method claimed in claim 8, wherein the duct of each module is positioned in the slab.

10. The method claimed in claim 1, wherein the step of casting the slab is performed on a casting rig.

11. The method claimed in claim 10, wherein the casting rig includes an upper surface with a reduced co-efficient of friction so that the modules can laterally translate thereacross.

12. The method claimed in claim 11, wherein the upper surface is coated with polytetrafluoroethylene.

13. The method claimed in claim 1, wherein the step of separating includes the step of actuating separation apparatus seated in channels between the new module and the previous module.

14. The method claimed in claim 13, wherein the separation apparatus includes inflatable balloons coupled to opposed sides of an elongate shaft.

15. The method claimed in claim 13, wherein the separation apparatus includes hydraulic jacks coupled to opposed sides of an elongate shaft.

16. The method claimed in claim 1, wherein the step of casting opposed sides walls of the new module, includes the step of coupling sheets of material to outer peripheral sides of the walls to facilitate easier separation of the new module from the previous module.

17. The method claim in claim 16, wherein the sheet of material is a polyethylene sheet.

18. A method of assembling a plurality of prefabricated prefinished volumetric construction (PPCV) modules, each being formed in accordance with the method claimed in claim 3, including the steps of:

(a) positioning a module in the series of modules against a matched previous module in the series;

(b) coupling the module and the previous module together; and (c) repeating steps (a) and (b) for each successive module in the series.

19. The method claimed in claim 18, wherein the step of positioning includes arranging corresponding locking channels to overlie one another to form combined locking conduits of vertical locks.

20. The method claimed in claim 19 including the step of inserting "C" channels into the locking channels.

21. The method claimed in claim 19, wherein the step of coupling includes the steps of pouring grout into the vertical locks.

22. The method claimed in claim 19, wherein the locks ensure the horizontal mechanical continuity of the slabs of the modules to transfer horizontal forces to the various resisting members.

23. The method claimed in claim 18, including the step of applying a compression force between the modules.

24. The method claimed in claim 23, wherein the step of applying the compression force is achieved through installing a pre-stressing cable through the modules.

* * * * *